United States Patent [19]

Brown

[11] 3,945,306

[45] Mar. 23, 1976

[54] INTEGRATED CEILING LIGHT AND AIR-CIRCULATION ARRANGEMENT

[75] Inventor: David James Brown, Winchester, England

[73] Assignee: Conder International Limited, Winchester, England

[22] Filed: Jan. 15, 1974

[21] Appl. No.: 433,524

[30] Foreign Application Priority Data

Jan. 17, 1973 United Kingdom ..... 2549/73

[52] U.S. Cl. ..... 98/40 DL; 98/40 D

[51] Int. Cl.[2] ..... F24F 7/06

[58] Field of Search ..... 98/40 DL, 32, 40 R, 40 D, 98/42; 240/47, 9 A, 9 R

[56] References Cited

UNITED STATES PATENTS

| | | | |
|---|---|---|---|
| 2,991,708 | 7/1961 | Falk et al. | 240/9 A |
| 3,045,577 | 7/1962 | Lazerson | 98/40 DL |
| 3,103,157 | 9/1963 | Quin | 98/40 DL |
| 3,108,529 | 10/1963 | Sweetser | 98/40 DL |
| 3,181,450 | 5/1965 | Kruger | 98/40 DL |
| 3,220,332 | 11/1965 | Straub | 98/40 DL |
| 3,246,137 | 4/1966 | Zagel | 240/9 A |
| 3,419,714 | 12/1968 | Slauer | 98/40 DL |
| 3,420,439 | 1/1969 | Meckler | 98/40 DL |
| 3,424,233 | 1/1969 | Meckler | 98/40 DL |

FOREIGN PATENTS OR APPLICATIONS

| | | | |
|---|---|---|---|
| 1,025,481 | 4/1966 | United Kingdom | 98/40 DL |

*Primary Examiner*—William E. Wayner
*Assistant Examiner*—Henry C. Yuen
*Attorney, Agent, or Firm*—Parmelee, Miller, Welsh & Kratz

[57] ABSTRACT

In the room of a building, a channel extends across above ceiling level and supports ceiling panels which form the ceiling itself, part of the channel being concealed by ceiling panels extending beneath the channel. Lighting elements are mounted in the other part of the channel, and air injection apertures extend along and outside each side of this part of the channel, for injecting air into the room.

8 Claims, 4 Drawing Figures

INTEGRATED CEILING LIGHT AND AIR-CIRCULATION ARRANGEMENT

BACKGROUND OF THE INVENTION

The invention relates to a ceiling light arrangement in a building, comprising an inverted channel with at least one light fitting therein, for mounting one or more lighting elements such as fluorescent tubes.

Normally, the channel is an item which is mounted on the ceiling once the ceiling support grid has been placed in position, and the lighting connections, etc., are made by working up through the grid. Separate air-circulation arrangements are usual, the air circulation arrangements permitting injection of air into the room beneath the ceiling and withdrawal of air from the room.

It is a general object of this invention to provide an integrated ceiling light arrangement and air-circulation arrangement which is constructionally simple and can be installed when constructing the ceiling.

BRIEF DESCRIPTION OF THE INVENTION

The present invention provides a building including a ceiling light arrangement comprising an inverted channel which acts as a structural member and supports ceiling panels, the lowermost part of the channel being substantially above the ceiling level, and at least one light fitting in the channel, for mounting one or more lighting elements, and also a method of providing a ceiling light arrangement in a building, comprising incorporating in the building an inverted channel to act as a structural member, supporting ceiling panels by means of the inverted channel in such a manner that the ceiling level is substantially below the lowermost part of the channel, and providing at least one light fitting in the channel, for mounting one or more lighting elements.

The invention enables the ceiling to be taken straight across beneath the channel at positions where there is no lighting element; smaller ceiling support members, running at right angles to the channel, can pass beneath the channel and ceiling panels can be secured with a secret fix (i.e. secured so that the securing arrangement cannot be seen from below); this is easier to construct and enables one to use standard products, and the ceiling panels, where they run beneath the channel, can protect items in the channel from fire. The channel itself can have a satisfactory fire rating if steel is used for the channel and, because the channel is a structural member, it can be continuous across the room or building and provide a long length for the actual positioning of the light and thus more flexibility. Raw edges can be masked, and in general, the light arrangement can have a good architectural effect as well as providing a low-glare, recessed light. The arrangement can be used to mount secondary equipment such as smoke detectors and the channel can house wiring so that it is accessible.

The light arrangement can be pre-assembled, and the connections, etc., can be made merely by working up through the bottom of the channel. This contrasts with present practice, where it is normal to put up a ceiling support grid and to arrange the lighting connections, etc., by working up through the grid.

The light arrangement preferably also includes at least one aperture for injection of air into a room or for the withdrawal of air from a room, thus providing an integrated lighting and air-circulation arrangement.

The aperture(s) may be in the upper part of the channel, particularly for the withdrawal of air as this cools the lighting elements whilst avoiding blowing the so heated air into the room; the ceiling void (i.e. the space above the ceiling but below the roof or floor above) preferably acts as a low pressure plenum chamber. The aperture(s) may be adjustable for the initial balance of the air circulation through the room, e.g. by having a number of aligned holes in the channel and a slide which slides in contact with the channel and has corresponding holes.

Alternatively, or preferably in addition, at least one of the apertures or a series of apertures can extend along the respective side of, and outside, the channel, particularly for the injection of air. At least one duct can be provided, adjacent the respective side wall(s) of the channel, for the aperture(s). Preferably the or each duct is of generally triangular shape, apex uppermost, in side view, with an inlet (or outlet) at the apex portion; such a shape can give an overpressure at the lower, outer end of the ducts, increasing the injection of air to zones between adjacent, aligned light arrangements. The duct can be very thin (relative to its length, the dimension measured parallel to the axis of the channel). If there is a duct on each side of the channel, the ducts can be interconnected by the cross-bar of a T-piece inlet (or outlet) and the limb of the T can be say horizontal or inclined to the vertical to reduce the depth of the ceiling void required. Interconnecting the ducts enables one to have a single connection for two inlet apertures (or series of inlet apertures), which is advantageous, requiring only half the number of distribution points.

In general, the height of the aperture(s) extending along the respective side of the channel is preferably adjustable relative to the channel itself. If there are respective apertures or series of apertures extending along each side of the channel, and ducts for the apertures, the ducts can be interconnected by one or more cross-members which are in turn connected to the top of the inverted channel by one or more adjustable members such as vertical screw-threaded members, for adjusting the vertical distance between the cross-member(s) and the channel top. The cross-members can be bridge-shaped, having a horizontal cross-piece and two vertical limbs depending therefrom, and ceiling support members, for supporting a ceiling on either side of the light arrangement, can be secured to the bottom portions of the limbs.

The or each duct may have a single long (generally slot-shaped) opening in its bottom, and a diffuser can be fitted in the opening to form a said aperture - the diffuser can be adjustable for the initial balance of the air circulation through the room. The diffusers can be connected by cross-members to form a frame.

A reflector for the lighting element(s) can be fitted in the interior of the channel and can have an open top or apertures in its top for air circulation. The arrangement preferably has internal projections (which may be continuous or nearly continuous projections) for supporting the reflector. The light fittings can be brackets which may be secured to the top of the inverted channel, but which are preferably secured to the reflector itself so that they can be removed with the reflector.

The present invention also provides a component support arrangement for supporting one or more components (for instance lighting control gear such as starters, chokes and capacitors, smoke detector equipment, or parts of sound generating equipment such as loudspeakers) in the ceiling of a building, the arrangement comprising a slidable member supported within an inverted channel for mounting in the ceiling; the channel may be the channel referred to above. The present invention also provides a building having the component support arrangement.

The slidable member (which may be referred to as a tray) can have projections which engage internal projections on the channel; the internal projections are preferably continuous except for spaced gaps which allow the projections on the slidable member to pass up and down therethrough. Preferably, the slidable member has two projections on each side, one adjacent each end, so that one pair of projections can be passed down through the respective gaps and the tray swung down about the other projections for inspection, maintenance or replacement of the components supported by the slidable member.

BRIEF DESCRIPTION OF THE DRAWINGS

The invention will be further described, by way of example, with reference to the accompanying drawings, in which.

DETAILED DESCRIPTION OF THE DRAWINGS

Figure 1:
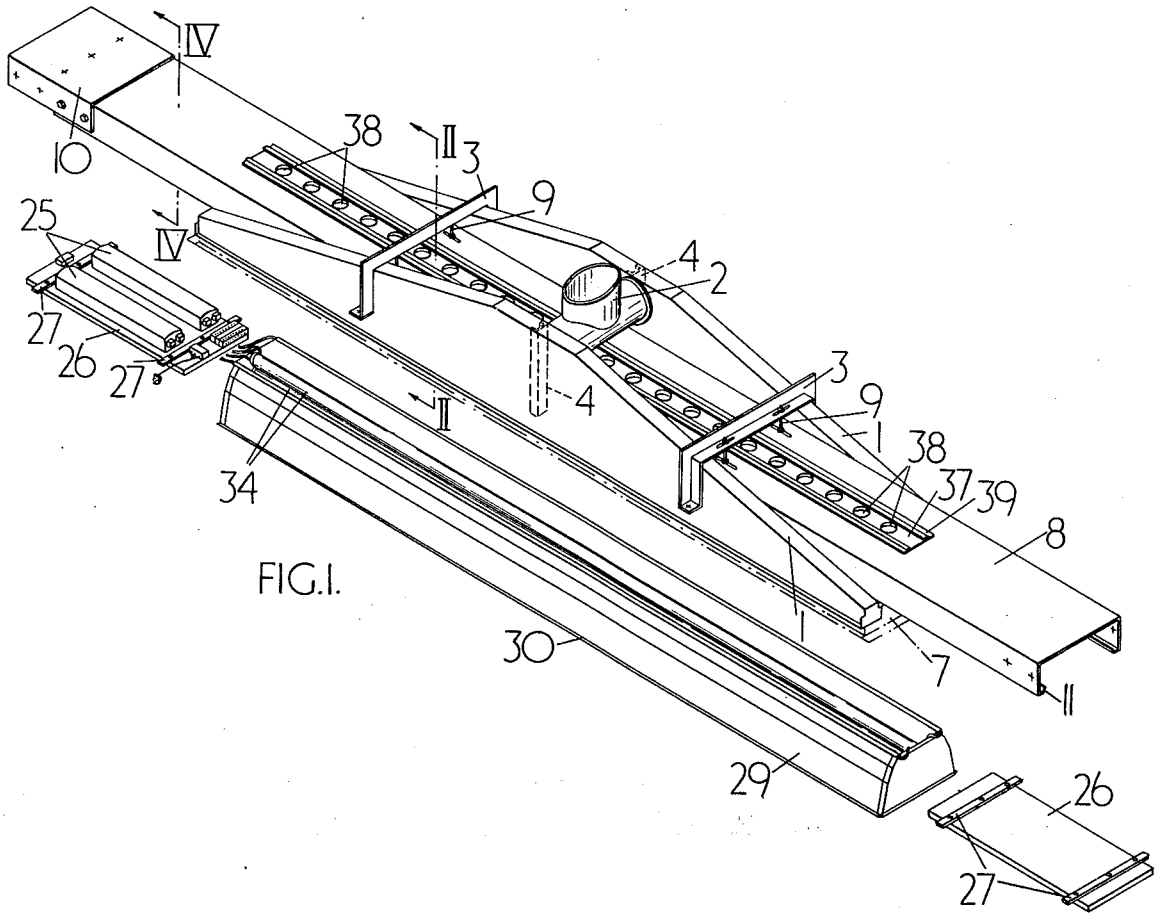
FIG. 1 is a perspective view of a ceiling light arrangement and component support arrangement in accordance with the invention, the light reflector and support trays being shown below the positions they would occupy in the assembled arrangement.

The ceiling light and support arrangement will be described in the sequence in which it is assembled.

Two air inlet ducts 1 of generally triangular shape are connected by a cross T-piece 2 which acts as an air inlet to both ducts, and by bridge-shaped cross-members in the form of support brackets 3 which may be pop-riveted to the outer sides of the respective ducts 1. The inlet ducts 1 and the cross T-piece 2 are made up in any suitable manner, and each air inlet duct 1 contains a baffle 4 which strengthens the fixing of the T-piece to the respective duct 1 but does not reach to the bottom of the duct. The ducts 1 can for instance be formed in 0.036 in. thick pre-galvanised steel which is welded or pop riveted.

A standard "Ozonair" one slot diffuser 5 is fitted into the bottom of each duct 1 and is sealed in position by suitable sealant 6 such as a foamed plastic strip adhered to the diffuser. The diffuser 5 may for instance be made out of extruded aluminium and can contain an arrangement for adjusting the air flow cross-section and/or for adjusting e.g. through 180° the angle at which the air is injected into the room, in particular in order to inject air across the ceiling into zones between adjacent, side-by-side ceiling light arrangements and adjacent, aligned ceiling light arrangements; the ducts 1 are tapered so that there is a greater air pressure at their ends than at their middles and more air passes out of their ends than their middles. The two diffusers 5 are interconnected by two cross-members or returns 7 to make a rigid frame - this interconnection will normally be made before fitting the diffusers 5 into the bottoms of the ducts 1. The returns 7 can then be secured to the ends of the ducts 1, e.g. by riveting.

An inverted channel 8, for instance rolled or pressed from pre-galvanished steel, is now inserted longitudinally between the ducts 1. The ducts 1 are supported on the top of the inverted channel 8 by means of screwed rods 9; the rods 9 pass through transverse slots in the support brackets 3 and longitudinal slots in the top of the inverted channel 8, enabling the ducts 1 to be adjusted in height, longitudinal position and transverse position relative to the inverted channel 8, and also enabling the ducts 1 to be tilted slightly in any direction with respect to the inverted channel 8, if required.

The end of the channel 8 has bolted thereto a channel connecting shoe 10, which enables the channel 8 to be bolted end-to-end to other similar channels - as an alternative, a flanged connection (not shown) could be used. The channel 8 has internal projections in the form of lips 11 which run the whole of its length apart from gaps or interruptions which are described in more detail below. The channel 8 may have a length equal to one module, for instance 12 ft. or 3.6 meters.

Figure 2:
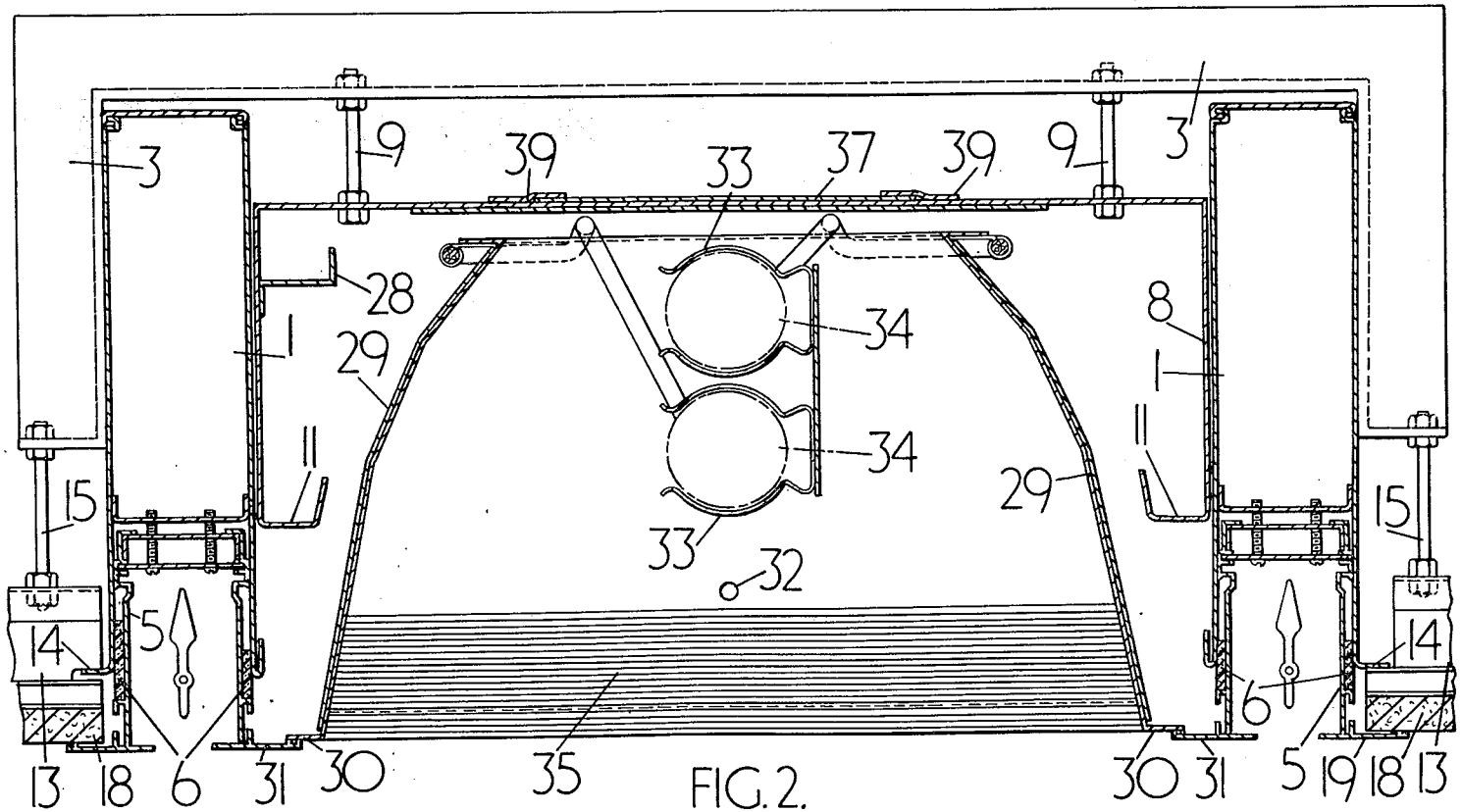
FIG. 2 is a section along the plane II—II of FIG. 1, the ceiling supports on either side being shown and being slightly different to one another.
Figure 3:
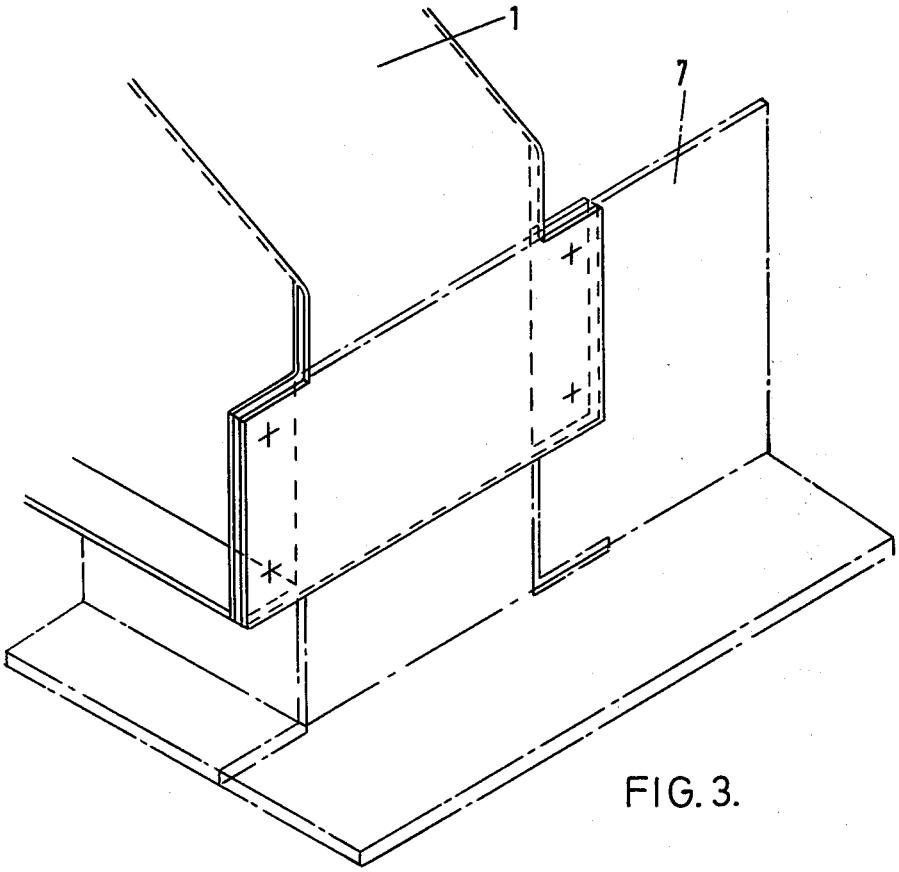
FIG. 3 is a perspective view, showing a detail of FIG. 1.
Figure 4:
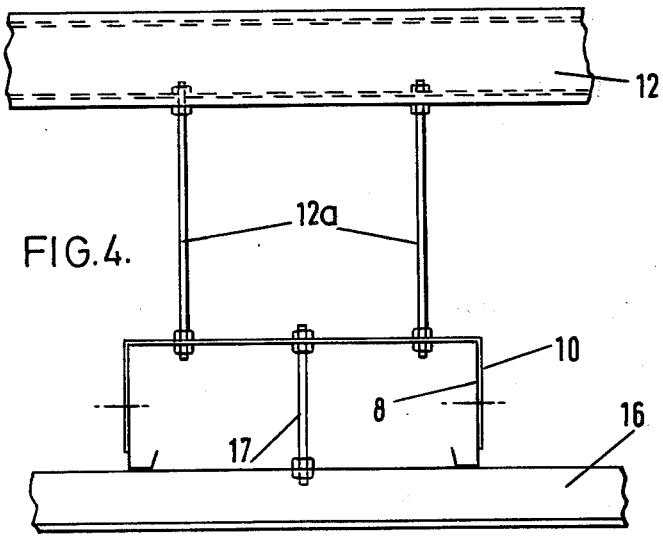
FIG. 4 is a section along the plane IV—IV of FIG. 1, showing a possible ceiling construction.

The channel 8 is now fitted into position to form a ceiling support member, the connecting shoes 10 (of which only one is shown) being suspended from a main beam 12 by screwed rods 12*a*(see FIG. 4); a pressure connection can be made to the inlet T-piece 2. Standard T-section subsidiary ceiling support members 13 are positioned e.g. so that they are aligned with outer lips 14 on the ducts 1 (right-hand side of FIG. 2) and are suspended from the support brackets 3 by screwed rods 15. If any such subsidiary ceiling support members run under the part of the channel 8 which is now not occupied by the light elements, the subsidiary ceiling support members can be secured to the channel 8 in any suitable manner, for instance as shown in FIG. 4, where a channel section 16 runs under the part of the channel 8 which is not occupied by light elements, and is connected to the shoe 10 by a screwed rod 17. Fire resistant ceiling panels 18 are secured to the subsidiary ceiling support members 13, preferably in such a manner that the securing devices cannot be seen and such that the panels abut one another beneath the subsidiary ceiling support members 13 and thus conceal the subsidiary ceiling support members 13. As can be seen in FIG. 2, outer lips 19 on the diffusers 5 engage just below the adjacent ceiling panels 18. To provide a component support arrangement, components 25 such as lighting control gear, smoke detection equipment or an acoustic generator such as a pink noise generator are now mounted on top of sliding trays 26 - the trays 26 can be prewired for all the lighting control gear; two bars 27 are bolted across the top of each tray 26, thus providing two spaced projections on each side of the tray. The internal lips 11 of the channel 8 have two pairs of gaps or interruptions, referred to as notches, on either side, one pair of notches being adjacent one end of the lighting fitting and the other pair of notches being adjacent the other end. These notches are just wide enough to allow the projecting ends of the bars 27 to pass up or down therethrough. In this way, one end of the first tray 26 is passed up into the interior of the channel 8 and then slid along so that the projecting ends of the bars 27 rest on the lips 11, the tray 26 then hanging down, supported by the respective bars 27.

The other end of the tray 26 can likewise be passed up into the interior of the channel 8 and the tray 26 can be slid along to the respective end of the channel 8. The other tray 26 can now be inserted, if required.

The channel 8 can have any suitable internal support 28 for wiring or other conduits, and the wiring arrangments of the light fitting can now be completed, working up through the bottom of the channel 8.

A standard parabolic reflector 29, with an open top, is now inserted up from below into the channel 8, so that the reflector bottom lips 30 rest on the inner lips 31 of the diffuser 5. The reflector 29 can be fixed in position for instance by a screw at each end passing through the hole 32. Bracket-mounted light fittings 33 can be secured directly to the reflector 29 so that the light fittings 33 and for instance fluorescent tubes 34 are removed when the reflector 29 is removed, leaving the space clear for access to the trays 26. A reflector strip (not shown) can be secured to the underside of the channel 8, above the reflector 29. The reflector 29 can have any suitable baffling or diffusing arrangement 35 for control of the light.

In use, the ceiling void is exhausted by a fan which will normally discharge the air to atmosphere; the low pressure in the ceiling void draws air up through the open top of the reflector 29 and through a series of apertures in the top of the channel 8, which series of apertures extends along the full length of the reflector 29. A slide 37 (see FIG. 2) having corresponding apertures 38 (see FIG. 1) is retained on top of the channel 8 by two joggled (offset) strips 39 which are pop riveted or spot welded to the top of the channel 8. Any suitable arrangement can be used for adjusting the slide 37. Air can also be arranged to be drawn along the channel section 8 and over say the components 25 to cool them.

The T-piece 2 is connected to the distribution (high pressure) side of any suitable ventilation, air heating or air conditioning system.

Prior to use, an air balance test is carried out on the room and the air flow cross-section of the diffusers 5 and of the apertures in the top of the channel(s) 8 are adjusted for proper balance.

If it is necessary to inspect the components 25 on a tray 26, the reflector 29 is removed, with if necessary prior removal of the light elements 34, the tray 26 is slid along into the gap so left, and its near end is swung down by passing the projecting ends of the near bar 27 down through respective notches in the channel lips 11.

I claim:

1. In a building having a load-bearing building structural framework and a plurality of rooms, in integrated ceiling light and air-circulation arrangment comprising:

an inverted ceiling support channel extending across the distance of at least one said room and carried by the framework;

ceiling panels;

ceiling panels mounting means carried by said channel and mounting said ceiling panels beneath the level of the lowermost portion of said channel, said panels extending beneath a first part of the length of said channel;

lighting element mounting means within said channel for mounting at least one lighting element within a second part of the length of said channel;

air injection means comprising injection aperture means extending along and outside each side of said second part of said channel, for injecting air into said room; and air withdrawal aperture means in the upper portion of said second part of said channel, for withdrawing air from said room.

2. The arrangement of claim 1, wherein said air injection means also comprises ducts terminating in said injection aperture means, and said arrangement further comprises mounting means passing over the top of said channel and secured to both said ducts, and adjustable connecting means connecting said mounting means to said channel, whereby the position of said injection aperture means relative to said channel can be adjusted.

3. The arrangement of claim 2, wherein said mounting means are bridge-shaped and each comprises a horizontal cross-piece to which said adjustable connecting means are secured, and two vertical limbs depending from respective ends of said cross-piece, said ducts being secured to said vertical limbs and at least some said ceiling panel mounting means being secured to the bottom ends of said limbs.

4. The arrangement of claim 2, wherein each said duct defines a horizontal, slot-shaped opening in its base, said opening extending parallel to said channel, and wherein said air injection means further comprises a diffuser fitted in each said opening and defining said injection aperture means, said diffuser being interconnected by cross-members extending beneath said channel, thereby forming a frame.

5. The arrangement of claim 1, wherein said air injection means also comprises ducts terminating in said injection aperture means, said ducts being thin and of triangular shape as seen in elevation and extending along respective sides of said channel, the bases of said ducts being horizontal and providing said injection aperture means, and an inlet T-piece which comprises a horizontal cross-bar and an inlet limb, the respective ends of said cross-bar communicating with the apices of respective said ducts.

6. The arrangement of claim 2, wherein said ducts are thin and of triangular shape as seen in elevation and extend along respective sides of said channel, the bases of said ducts being horizontal and providing said injection aperture means, and an inlet T-piece which comprises a horizontal cross-bar and an inlet limb, having the respective ends of said cross-bar communicating with the apices of respective said ducts.

7. The arrangement of claim 1, and further comprising removable reflector means fitted into said second part of said channel, said lighting element mounting means being fixed to said reflector means, whereby said lighting element mounting means are removed when said reflector means is removed.

8. The arrangement of claim 1, wherein said channel has internal lips defining at least one pair of interruptions therein, one interruption being on each side of said channel, said arrangement further comprising a slidable component support member having two lateral projections on each side thereof, said lateral projections resting on said lips and at least one pair of said lateral projections being able to pass through said interruptions.

* * * * *